United States Patent [19]

Diehl et al.

[11] Patent Number: 4,669,682

[45] Date of Patent: Jun. 2, 1987

[54] GUIDE BEAM AND TRACKING SYSTEM

[75] Inventors: Christian Diehl; Ernst Lill; Horst Kirsche, all of Munich, Fed. Rep. of Germany

[73] Assignee: Messerschmitt-Boelkow-Blohm Gesellschaft mit beschraenkter Haftung, Munich, Fed. Rep. of Germany

[21] Appl. No.: 829,714

[22] Filed: Feb. 14, 1986

[30] Foreign Application Priority Data

Feb. 20, 1985 [DE] Fed. Rep. of Germany ..... 3505804

[51] Int. Cl.[4] ..... F41G 7/26

[52] U.S. Cl. ..... 244/3.13

[58] Field of Search ..... 244/3.13

[56] References Cited

U.S. PATENT DOCUMENTS 4,111,383 9/1978 Allen et al. ..... 244/3.13

4,195,799 4/1980 Sogo et al. ..... 244/3.13

FOREIGN PATENT DOCUMENTS 2658689 7/1977 Fed. Rep. of Germany .

3149808 6/1983 Fed. Rep. of Germany ..... 244/3.13

*Primary Examiner*—Charles T. Jordan

*Attorney, Agent, or Firm*—W. G. Fasse; D. H. Kane, Jr.

[57] ABSTRACT

A guide beam and tracking system for steering a flying body toward a target in accordance with the beam rider principle, is constructed for use under adverse weather conditions. Even under such adverse weather conditions a highly accurate target acquisition is assured due to the use of optical conversion, and beam expansion in the transmitter path, and heterodyning in the laser receiver. It is thus possible to achieve in addition to the highly accurate target acquisition, an accurate tracking of a flying body moving toward a target, under the control of a guide beam device.

8 Claims, 1 Drawing Figure

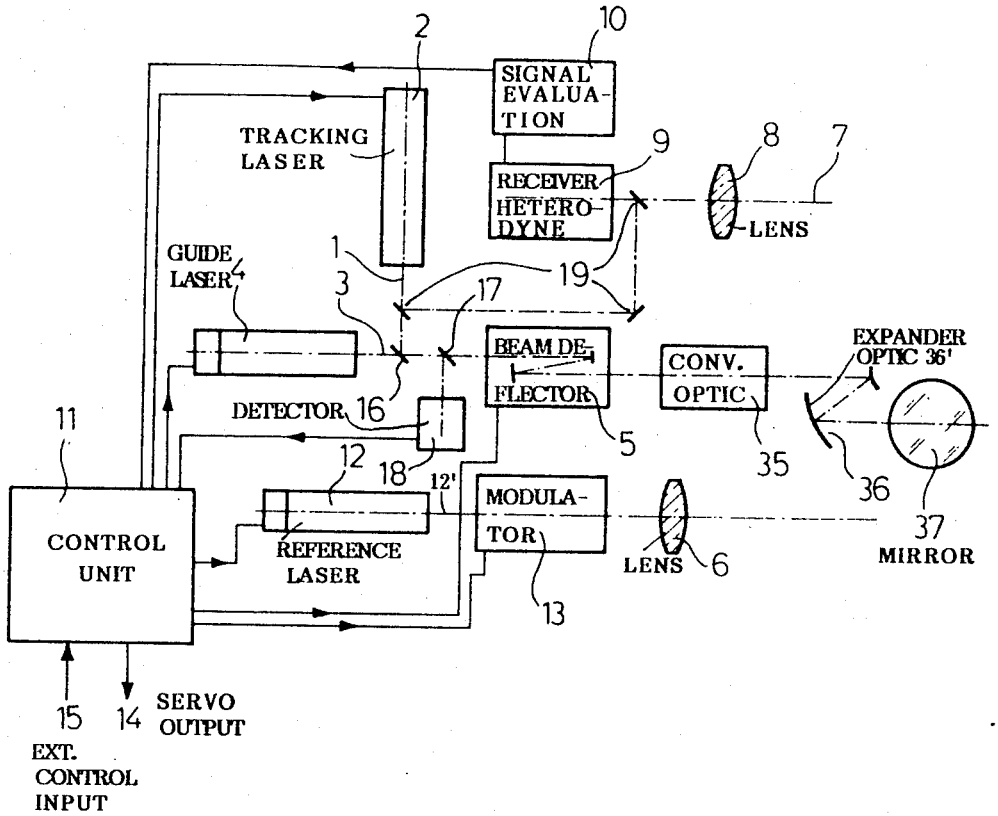
2
10
SIGNAL EVALUATION
TRACKING LASER
9
8
7
RECEIVER HETERODYNE
LENS
GUIDE LASER
1
19
3
17
BEAM DEFLECTOR
CONV. OPTIC
EXPANDER OPTIC 36'
DETECTOR
16
5
35
36
11
12
18
12'
MODULATOR
37
MIRROR
CONTROL UNIT
REFERENCE LASER
LENS
6
13
15
14
SERVO OUTPUT
EXT. CONTROL INPUT

GUIDE BEAM AND TRACKING SYSTEM

CROSS-REFERENCE TO RELATED APPLICATIONS

The present application is related to copending patent application U.S. Ser. No. 798,759; filed on Nov. 15, 1985, and assigned to the same Assignee.

FIELD OF THE INVENTION

The invention relates to a guide beam and tracking system for steering flying bodies in accordance with the beam rider principle employing a scanning laser beam and an optical arrangement of a guide laser beam aligned in parallel to the scanning laser beam. A reference laser beam and a receiver are also part of such a system.

DESCRIPTION OF THE PRIOR ART

German Patent (DE-PS) No. 2,658,689 discloses a method for guiding flying bodies employing a laser beam which is deflected on a spiral path for steering a flying object. A follower guiding or tracking relative to a sight line aimed at a target is not disclosed by this method.

U.S. Pat. No. 4,111,383 describes a device for steering a flying body in accordance with the beam rider principle. The steering device employs lasers which are deflected in the x-y-coordinate directions for producing a guide beam. The known system further comprises a synchronizing laser and a telescope sight. In the known system, means for controlling the synchronizing laser are effective at points of time at which the beams of the guide beam laser imaged into the sight cross the sight line to a target. This type of following or target tracking is rather slow in practice. Further, compared to the guide beam tracking of a flying body, the known system is rather unprecise.

The guide beam and tracking system disclosed in copending Ser. No. 798,759 accomplishes a highly precise target acquisition and control of flying bodies toward a target on the basis of the beam rider principle. However, the copending disclosure is suitable primarily for use under fair weather atmospheric conditions. The disclosure of copending U.S. Ser. No. 798,759 is incorporated herein by reference.

OBJECTS OF THE INVENTION

In view of the foregoing it is the aim of the invention to achieve the following objects singly or in combination:

to improve a guide beam and tracking system of the type here described in such a way that it provides a highly precise target acquisition and tracking or follow-up of the control system even under adverse weather conditions; and to construct such a system so that a high accuracy of the target acquisition is accompanied by an accurate tracking of a flying body toward a target.

SUMMARY OF THE INVENTION

The foregoing objects have been accomplished by the combination of the following features characterizing the invention. A laser tracking beam of a $CO_2$-tracking laser or laser generator is imaged into the beam path of a guiding laser beam of a solid state guide beam laser or laser generator. The transmitted tracking laser beam and the transmitted guiding laser beam pass sequentially through an x-y-deflection means, through a conversion optical means, through an expander optical means, and through an output means. The just mentioned four means are preferably respective mirrors optically arranged in series. The reflected laser light is transmitted through an optical member to an input of a heterodyne laser light receiver for producing output signals which are supplied through an evaluating circuit to a control unit which controls a modulator of a reference laser beam and the x-y-deflection means. Preferably, the control unit also controls the guide laser, the reference laser, and the tracking laser.

BRIEF DESCRIPTION OF THE DRAWINGS

In order that the invention may be clearly understood, it will now be described, by way of example, with reference to the single figure of the accompanying drawing which shows a block diagram of the present system.

DETAILED DESCRIPTION OF A PREFERRED EXAMPLE EMBODIMENT AND OF THE BEST MODE OF THE INVENTION

The system comprises a first laser generator 4 which is a solid state laser generator for the present purposes for producing a guide laser beam 3. The system includes further a second laser generator 12 for generating a reference laser beam 12'. A third laser generator is a $CO_2$-laser for the purposes of the invention to produce a tracking laser beam 1. The solid state first laser generator 4 may, for example, comprise erbium as the lasing element for producing the guide laser beam 3. An x-y-deflection unit 5, for example a suitable deflection mirror, deflects the guide beam 3 along a spiral pattern. A conversion optical member 35, for example also a suitable mirror, is arranged downstream of the beam deflection unit 5. An expander optical member 36, also for example a mirror, is arranged downstream of the conversion unit 35. A mirror 36' deflects the converted beam onto the expander mirror 36 which in turn guides or images the beam onto the output mirror 37. The mirror 37 is a stabilized mirror forming the output of the laser projector. The laser beam 12' of the second laser generator 12, which may also be a solid state laser, assures the timed synchronization of the system. For this purpose the reference laser beam 12' is passed through a modulator 13 and through an optical member such as a lens 6. The third laser generator is, as mentioned, a $CO_2$-laser, more specifically, a waveguide laser producing the tracking laser beam 1 which is coupled into the path of the guide laser beam 3 by means of a dichroic mirror 16. Thus, the laser beam 1 also passes sequentially through the beam deflection unit 5, through the conversion optical mirror 35, through the expander optical mirrors 36', 36, and through the mirror 37. The third laser 2, or rather its beam 1, serves for marking the target silhouette in a known manner.

The laser light 7 scattered back from an illuminated target, not shown, is received in an optical member such as a lens 8 and supplied to the input of a heterodyne receiver 9. A set of mirrors 19 image a portion of the tracking laser beam 1 into the input of the heterodyne receiver 9 for heterodyning with the received scattered laser light 7. The output signal from the receiver 9 is supplied to a signal evaluation circuit 10 shown in more detail in the above mentioned copending application. The signal evaluation circuit 10 produces a control signal at its output which is supplied to the control unit 11 also disclosed in more detail in the copending application. The control unit 11 coordinates all the functions of the guide laser generator 4, of the second laser generator 12 producing the reference beam and of the third laser generator 2 producing the tracking laser beam. The control unit 11 also controls the modulator 13 as well as the x-y-deflection unit 5. Additionally, the control unit 11 has a servo-output 14 for providing a control signal to the drive of a tracking unit not shown. The control unit 11 further comprises a control input 15 for supplying to the control unit 11 externally acquired data for the purpose of properly aligning and aiming the tracking unit.

In the beam path of the guide laser 4 there is arranged an optical decoupling member 17 such as a mirror which decouples a portion of the guide beam 4 to supply this decoupled portion to an input of a detector 18 to produce a signal which harmonizes through the control unit 11 the guide laser beam 3 and the tracking laser beam 1.

The present guide beam and tracking system is a two color system due to the different wavelengths which are used. For example, the $CO_2$-waveguide laser 2 producing the tracking beam operates at a wavelength of 10.6 microns for the tracking beam. The first laser generator operates, for example, at a wavelength of 1.6 microns for the guide laser beam 3. As in the above mentioned U.S. Ser. No. 798,759, the flying body is guided by a solid state laser. However, by using a $CO_2$-waveguide laser for the tracking laser generator 2, the present system is able to work even under adverse weather conditions because the $CO_2$-laser beam 1 is much more able to traverse the distance from the projector to a target and back again than a laser beam from a solid state laser. The distance from the projector to the target must be traversed twice and on the return part of the travel the light is no longer coherent. The invention solves this problem by using a cooled detector in the receiver 9 and by operating with the heterodyning or superheterodyning principle. Accordingly, the entire silhouette or figure to be scanned by the guide beam and by the tracking device as disclosed in the copending U.S. Ser. No. 798,759, is projected in two colors, that is once by the solid state laser beam 3, and once by the $CO_2$-waveguide laser beam 1. Since the flying body receives the radiation from the solid state laser, it is possible to make do with a simple receiver. The longer wavelength, for example 10.6 microns for the $CO_2$-laser, is used for scanning. In order to process both wavelengths, 10.6 and 1.6 microns simultaneously, the serially arranged components 5, 35, 36', 36, and 37 are embodied by suitable mirror optical means.

The special advantage of the system according to the invention is its highly precise target acquisition by employing a beam rider guidance system which is capable to achieve such highly precise target acquisition even under adverse weather conditions.

Although the invention has been described with reference to specific example embodiments, it will be appreciated, that it is intended to cover all modifications and equivalents within the scope of the appended claims.

What we claim is:

1. A guide beam and tracking system for steering a flying body in accordance with the beam rider principle, comprising a first solid state laser generator (4) for producing a guide laser beam (3), a second laser generator (12) for producing a reference laser beam (12'), a modulator (13) arranged for modulating said reference laser beam (12'), a third $CO_2$-laser generator (2) for producing a tracking laser beam (1), heterodyne receiver means (8, 9) for receiving laser light reflected by a target, means (16) for imaging said tracking laser beam (1) of said third $CO_2$-laser generator (2) into a path of said guide laser beam (3) produced by said first solid state laser generator (4), a common x-y-deflection device (5), conversion optical means (35), expander optical means (36), and an output means (37) all arranged in sequence so that said tracking laser beam (1) and said guide laser beam (3) pass sequentially through said x-y-deflection device (5), through said conversion optical means (35), through said expander optical means (36) and through said output means (37), said heterodyne receiver means (9) including receiver input means (8) for receiving reflected laser light (7) and for providing receiver output signals; evaluating circuit means (10) connected to said heterodyne receiver means for receiving said receiver output signals to produce a control signal, a control unit (11) connected for receiving said control signal from said evaluating circuit means (10), said control unit (11) having control output terminals connected for controlling said modulator (13) and said x-y-deflection device (5) for target acquisition and for target tracking.

2. The system of claim 1, wherein said control unit has further output means connected to said first solid state laser generator (4) for controlling the generation of said guide laser beam (3), to said second laser generator (12) for controlling the generation of the reference laser beam (12') and to said third $CO_2$-laser generator (2) for controlling the generation of said tracking laser beam (1).

3. The system of claim 1, further comprising mirror means (19) arranged for imaging a portion of said tracking laser beam (1) of said $CO_2$-laser generator (2) into an input light path of said heterodyne receiver means (9) for a heterodyning operation of said receiver means.

4. The system of claim 1, wherein said third $CO_2$-laser generator (2) for producing said tracking laser beam (1) is a waveguide laser.

5. The system of claim 4, wherein said waveguide laser has an operating wavelength of 10.6 microns for said tracking laser beam (1).

6. The system of claim 1, wherein said receiver means comprise cooled detector means for receiving reflected laser light.

7. The system of claim 1, wherein said first solid state laser generator for producing said guide laser beam (3) has an operating wavelength of 1.6 microns for said guide laser beam (3).

8. The system of claim 1, wherein said x-y-deflection unit (5), said conversion optical means (35), said expander optical means (36), and said output means (37) each comprise a mirror for the respective purpose.

* * * * *